US005219167A

United States Patent [19]

Hamano

[11] Patent Number: 5,219,167

[45] Date of Patent: Jun. 15, 1993

[54] STOP-CONTROL DEVICE OF ROTARY GAMING MACHINE

[75] Inventor: Junichi Hamano, Osaka, Japan

[73] Assignee: Takasago Electric Industry Co. Ltd., Osaka, Japan

[21] Appl. No.: 787,299

[22] Filed: Nov. 4, 1991

[30] Foreign Application Priority Data

Feb. 16, 1991 [JP] Japan ..... 3-44357

[51] Int. Cl.[5] ..... G07F 17/34

[52] U.S. Cl. ..... 273/143 R

[58] Field of Search ..... 273/138 A, 143 R

[56] References Cited

U.S. PATENT DOCUMENTS 4,448,419 5/1984 Telnaes ..... 273/143 R
4,711,451 12/1987 Pajak et al. ..... 273/143 R
4,858,932 8/1989 Keane ..... 273/143 R
5,085,436 2/1992 Bennett ..... 273/143 R

*Primary Examiner*—Benjamin H. Layno
*Attorney, Agent, or Firm*—Frank J. Jordan

[57] ABSTRACT

The present invention relates to a stop control device of a slot gaming machine used for controlling the stop-action of rotary units such as reels in a rotary gaming machine. In the rotary gaming machine, a table for allocating voluntary time length data to each symbol on such rotary units is stored in a memory. It is possible to appoint symbols one by one by operating a symbol appointing circuit and to renew appointed symbols by operating the symbol appointing circuit at each time when the counted values coincide with time length data in the time allocating table. Thus, control is made so that the symbols appointed by the appointing circuit stop at a defined stop line. Under such configuration, any voluntary change of the probability of appearance for a certain combination mode of each symbol can be simply performed by merely changing the contents of the time-allocating table stored in the memory.

9 Claims, 10 Drawing Sheets

TB

| NUMBER | SYMBOL | 1ST REEL | 2ND REEL | 3RD REEL |
|---|---|---|---|---|
| 1 | M7 | 1 | 1 | 2 |
| 2 | – | 2 | 2 | 2 |
| 3 | 1B | 2 | 2 | 1 |
| 4 | – | 1 | 1 | 1 |
| 5 | 3B | 2 | 2 | 2 |
| 6 | – | 1 | 1 | 1 |
| 7 | R7 | 2 | 1 | 2 |
| 8 | – | 1 | 2 | 1 |
| 9 | 3B | 2 | 2 | 2 |
| 10 | – | 1 | 1 | 1 |
| 11 | 1B | 2 | 2 | 1 |
| 12 | – | 1 | 1 | 2 |
| 13 | B7 | 2 | 2 | 1 |
| 14 | – | 1 | 2 | 2 |
| 15 | 2B | 2 | 2 | 2 |
| 16 | – | 1 | 1 | 1 |
| 17 | 1B | 2 | 2 | 2 |
| 18 | – | 1 | 1 | 1 |
| 19 | R7 | 2 | 1 | 1 |
| 20 | – | 1 | 2 | 2 |
| 21 | 3B | 2 | 1 | 1 |
| 22 | – | 1 | 1 | 2 |

FIG. 4

| | |
|---|---|
| 1 | M 7 |
| 2 | — |
| 3 | 1 B |
| 4 | — |
| 5 | 3 B |
| 6 | — |
| 7 | R 7 |
| 8 | — |
| 9 | 3 B |
| 10 | — |
| 11 | 1 B |
| 12 | — |
| 13 | B 7 |
| 14 | — |
| 15 | 2 B |
| 16 | — |
| 17 | 1 B |
| 18 | — |
| 19 | R 7 |
| 20 | — |
| 21 | 3 B |
| 22 | — |

FIG. 5

TB

| NUMBER | SYMBOL | 1ST REEL | 2ND REEL | 3RD REEL |
|---|---|---|---|---|
| 1 | M 7 | 1 | 1 | 2 |
| 2 | — | 2 | 2 | 2 |
| 3 | 1 B | 2 | 2 | 1 |
| 4 | — | 1 | 1 | 1 |
| 5 | 3 B | 2 | 2 | 2 |
| 6 | — | 1 | 1 | 1 |
| 7 | R 7 | 2 | 1 | 2 |
| 8 | — | 1 | 2 | 1 |
| 9 | 3 B | 2 | 2 | 2 |
| 10 | — | 1 | 1 | 1 |
| 11 | 1 B | 2 | 2 | 1 |
| 12 | — | 1 | 1 | 2 |
| 13 | B 7 | 2 | 2 | 1 |
| 14 | — | 1 | 2 | 2 |
| 15 | 2 B | 2 | 2 | 2 |
| 16 | — | 1 | 1 | 1 |
| 17 | 1 B | 2 | 2 | 2 |
| 18 | — | 1 | 1 | 1 |
| 19 | R 7 | 2 | 1 | 1 |
| 20 | — | 1 | 2 | 2 |
| 21 | 3 B | 2 | 1 | 1 |
| 22 | — | 1 | 1 | 2 |

FIG. 6

| | 1ST REEL | 2ND REEL | 3RD REEL |
|---|---|---|---|
| POINTER | SP1 | SP2 | SP3 |
| COUNTER | TC1 | TC2 | TC3 |

WE

FIG. 10

1

| | |
|---|---|
| 1 | TC |
| 2 | – |
| 3 | 1B |
| 4 | – |
| 5 | 3B |
| 6 | – |
| 7 | RC |
| 8 | – |
| 9 | 2B |
| 10 | – |
| 11 | 1B |
| 12 | – |
| 13 | BC |
| 14 | – |
| 15 | 2B |
| 16 | – |
| 17 | 1B |
| 18 | – |
| 19 | GC |
| 20 | – |
| 21 | 3B |
| 22 | – |

→

2

| | |
|---|---|
| 1 | TC |
| 2 | – |
| 3 | 1B |
| 4 | 1B |
| 5 | – |
| 6 | 3B |
| 7 | 3B |
| 8 | – |
| 9 | RC |
| 10 | RC |
| 11 | – |
| 12 | 2B |
| 13 | 2B |
| 14 | – |
| 15 | 1B |
| 16 | 1B |
| 17 | – |
| 18 | BC |
| 19 | BC |
| 20 | – |
| 21 | 2B |
| 22 | 2B |
| 23 | – |
| 24 | 1B |
| 25 | – |
| 26 | GC |
| 27 | GC |
| 28 | GC |
| 29 | GC |
| 30 | GC |
| 31 | – |
| 32 | 3B |
| 33 | 3B |
| 34 | – |

STOP-CONTROL DEVICE OF ROTARY GAMING MACHINE

FIELD OF THE INVENTION

The present invention relates to a stop control device of a rotary gaming machine, which is used for controlling the stop-action of a rotary units such as reels in the rotary gaming machine such as a slot machine.

DESCRIPTION OF THE PRIOR ART

In a conventional slot machine, there are provided 3 reels having a plurality of symbols shown on their peripheral surface. The reels start rotation all together by a handle operation after coins are shot or inserted into the machine, and after the elapse of a certain time, the reels are made to stop one after another. As a result, one of the symbols of each reel comes to appear at a defined stop line. Depending upon the mode of combination of those symbols, the game and the number of coins to be paid out are decided.

In a typical slot machine, a certain number of the above-mentioned symbols are provided, for instance, 22 symbols per each reel, and the payout amount of coins is determined in accordance with the appearing frequency of a mode of combination of symbols.

In the conventional slot machine, each reel is constituted by sticking a tape which has a predetermined number of symbols around the peripheral side surface of the reel frame. In order to change the probability of appearance for a certain mode of combination of symbols, the tape has to be replaced with another tape having a different number of symbols.

FIG. 10-(1) shows an example of the layout of symbols. In this instance the number of the symbols is 22, including such symbols related to a winning game as "TC", IB, "3B", and also such symbols have no relevance to the winning game indicated as "—". When three such reels having these kinds of symbol arrangement are provided, a total number of symbol combinations will be $22\times22\times22=10{,}648$.

In order to change the above-mentioned probability of appearance in such a slot machine having this arrangement of symbols, it is necessary to replace the reels with other ones having a different arrangement of symbols, for example, as shown in FIG. 10-(2). In said figure, the number of symbols are 34 and the number of combinations of symbols is $34\times34\times34=39{,}304$.

For changing the probability of appearance, other than actually changing the reels to ones having a different numbers of symbols by renewing the tape on the reels, it is also possible to prepare a program with virtual reels having such different symbols, and rotating the virtual reels virtually to stop one of the symbols on a virtual stop-line. In this case, the reels are controlled to stop in a manner such that these symbols coinciding with the symbols on the virtual stop-line stop on the actual stop line.

In this method, however, whenever changing the reels having a different number of symbols, it is necessary to prepare virtual reels each time, which means a very complicated work.

BRIEF DESCRIPTION OF THE INVENTION

The present invention is characterized in that a stop-control device of a rotary gaming machine provided with a plurality of rotary units indicating a plurality of symbols, includes memory means, symbol appointing means, counting means and renewing means as well as stop-control means. In the above-mentioned memory means, a time allocating table for allocating data to each symbol is incorporated. The above-mentioned symbol appointing means appoints each symbol one by one on the rotary units in the above-mentioned time allocating table. The above-mentioned counting means counts the time length for appointing symbols by the above-mentioned symbol appointing means. The above-mentioned renewing means renews the symbols to be appointed by operating the above-mentioned symbol appointing means each time when the above-mentioned counted value coincides with the time data in the above-mentioned time allocating table. The above-mentioned stop-control means controls the stop action of each rotary unit so that the appointed symbols by the above-mentioned appointing means stop at the defined stop line.

It is therefore an object of this invention to offer a stop-control device for a rotary gaming machine that can freely change the probability of appearance of each symbol combination very simple without requiring the replacement of the tape stuck on the reels nor fabricating any virtual reel.

In accordance with this invention, therefore, for changing the probability of appearance of a certain mode of symbol combinations, it is sufficient to change the contents of the time allocating table contained in the memory means, meaning that this invention can change the above-mentioned probability of appearance very easily with no relevance to the number of symbols.

The above-mentioned objects and characteristics as well as the merits of the present invention will be more clearly known by the following descriptions made with reference to the accompanying drawings.

BRIEF DESCRIPTION OF THE DRAWINGS

FIG. 4 is a table showing the layout of symbols on a peripheral side surface of each reel.

FIG. 5 is a table showing a specific example of a time allocating table.

FIG. 6 is a table showing the contents of the work area of the RAM.

FIG. 10 is a table showing a conventional method for changing the probability of appearance of symbols.

DETAILED DESCRIPTION OF THE PREFERRED EMBODIMENTS

Figure 1:
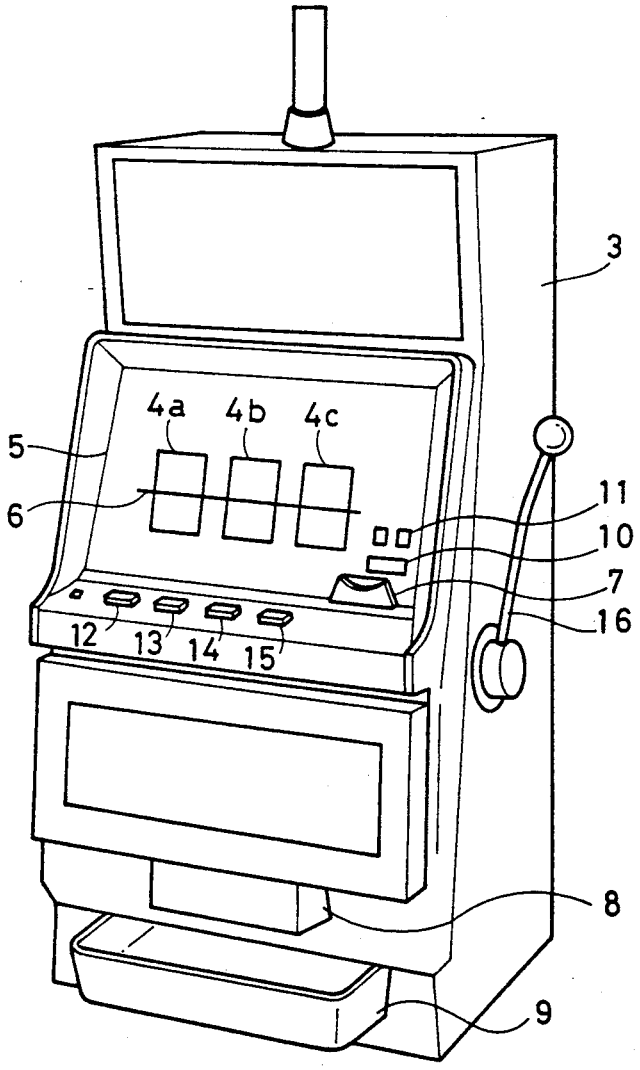
FIG. 1 is a perspective view showing an embodiment of a slot machine of the present invention.

FIG. 1 shows an embodiment of a slot machine embodying the present invention, wherein three reels 4*a*, 4*b* and 4*c* are contained and arranged in a machine body 3. On the peripheral surface of each respective reel, a plurality of symbols as shown in FIG. 4 are indicated in an aligned state, and through a front display window 5, the rotating state of the respective reels, and particularly three symbols, can be confirmed when the reel is at a standstill. In FIG. 4, "M7", "R7", "B7", "1B", "2B" and "3B" represent the symbols for a winning game, while "—" shows the symbol unrelated with a winning game.

At the center of the display window 5, there is indicated a stop line 6, whereon, when the reels are at a standstill, one symbol of each reel comes to a stop, with the preceding symbol and succeeding symbol appearing at the upper and lower position of the stop line respectively.

In the figure, numeral 7 designates a coin-insertion port, numeral 8 designates a coin-payout port and numeral 9 is a coin-receiving plate for the paid out coins.

In the case of a slot machine exemplified in the drawing, besides coin-insertion part to which three coins are shot inserted into the machine, before each game, games can be played by the player who deposits more coins in advance into the same coin insertion port 7. However, when the coins inserted into the machine is two, the payout of coins are two times the set value, and for three inserted coins, three times will be the gain in the winning game.

At the edge portion of the display window 5, a stock-coin display 10 and a shot-coin display 11 are provided, and under the display window 5 a coin-clearance button switch 12, a game start button switch 13, a coin-register button switch 14 and a maximum coin-register button switch 15 are disposed.

The above-mentioned stock-coin display 10 indicates the number of coins deposited in the machine, and the shot-coin display 11 indicates the number of coins to be inserted into the machine by pushing the coin-register button switch 14 or the maximum coin-register button switch 15.

The above-mentioned coin-register button switch 14 is for instructing the number of coins to be inserted into the machine for deposit. One push of this coin-register button switch 14, is for one coin, two pushes for 2 coins and three pushes for 3 coins respectively, for insertion into the machine. The above-mentioned maximum coin-register button switch 15 (in this example, 3 coins) is for instructing the maximum acceptable number of coins.

The above-mentioned coin-clearance button switch 12 is for clearing the coins used, that is, pushing this button switch will discharge the number of stocked coins indicated by the stock-coin display 10 from the coin pay-out port 8 to the coin-receiver plate 9. The game-start switch 13 is for starting the game. By using this push button after inserting the coins three reels 4*a*, 4*b* and 4*c* start all together as in the case of operating the game-start handle 16 on the side panel of the machine.

Figure 2:
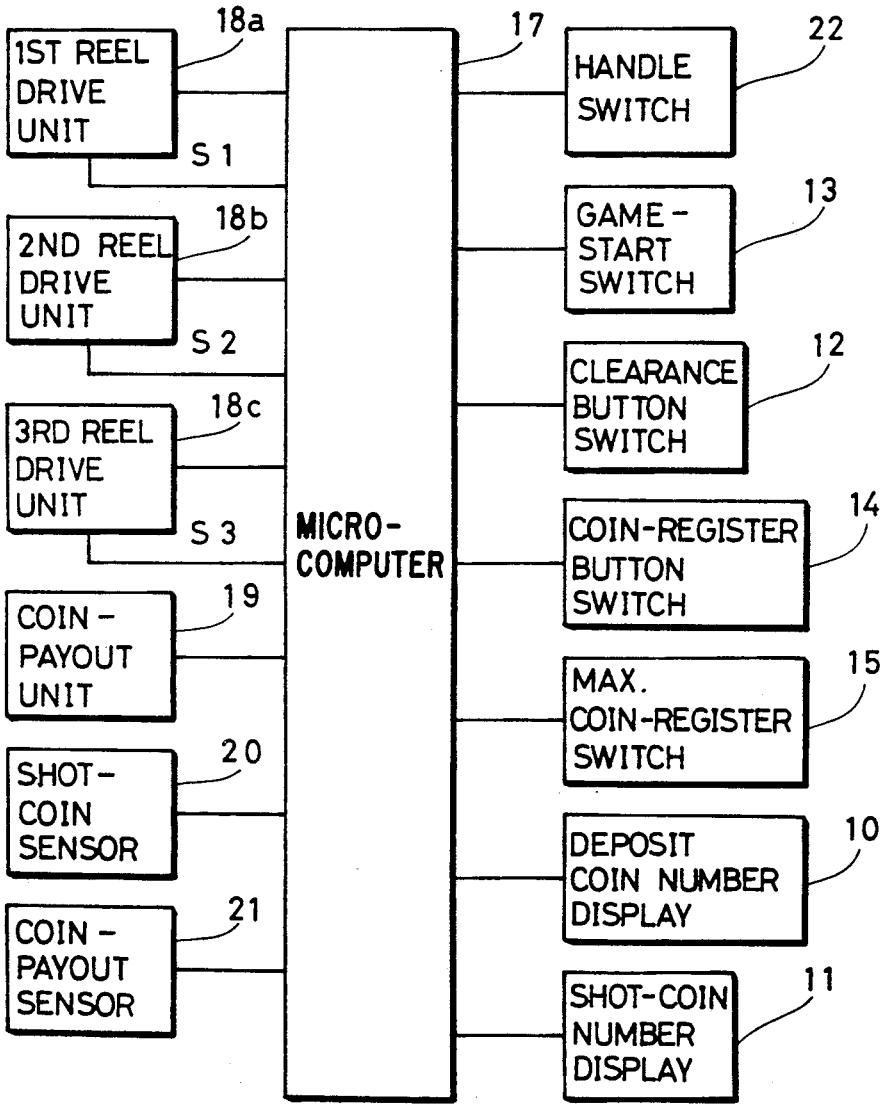
FIG. 2 is a block diagram showing a configuration of circuit of the slot machine.

FIG. 2 shows a schematic circuit configuration, which, in addition to driving units 18*a*–18*c* of the first to third reels connected to a microcomputer 17, input/output devices of a coin-payout unit 19, a shot-coin sensor 20, coin-payout sensor 21, a handle switch 22, game-start switch 13, coin-clearance switch 12, coin-register switch 14, maximum coin-register switch 15, maximum stock-coin display 10 and shot-coin display 11 are also connected thereto.

The driving units of reels 18*a*–18*c* include stepping motors as the driving power sources of the reels 4*a*, 4*b*, 4*c*, and the microcomputer 17 applies driving pulses to the stepping motors to operate them. The microcomputer 17 counts the driving pulses and resets the count value by use of reference signals S1, S2 and S3 which indicate the reference positions of the reels to detect the symbols positioned on the stop line 6.

The above-mentioned coin-payout unit 19 conveys the coins to be paid out or to be cleared to the pay-out port 8. The shot-coin sensor 20 detects the coins carried to the coin-insertion port 7, and the coin-payout sensor 21 detects the coins fed by the coin-payout unit 19. The handle switch 22 is turned on by operating the start handle 16.

Figure 3:
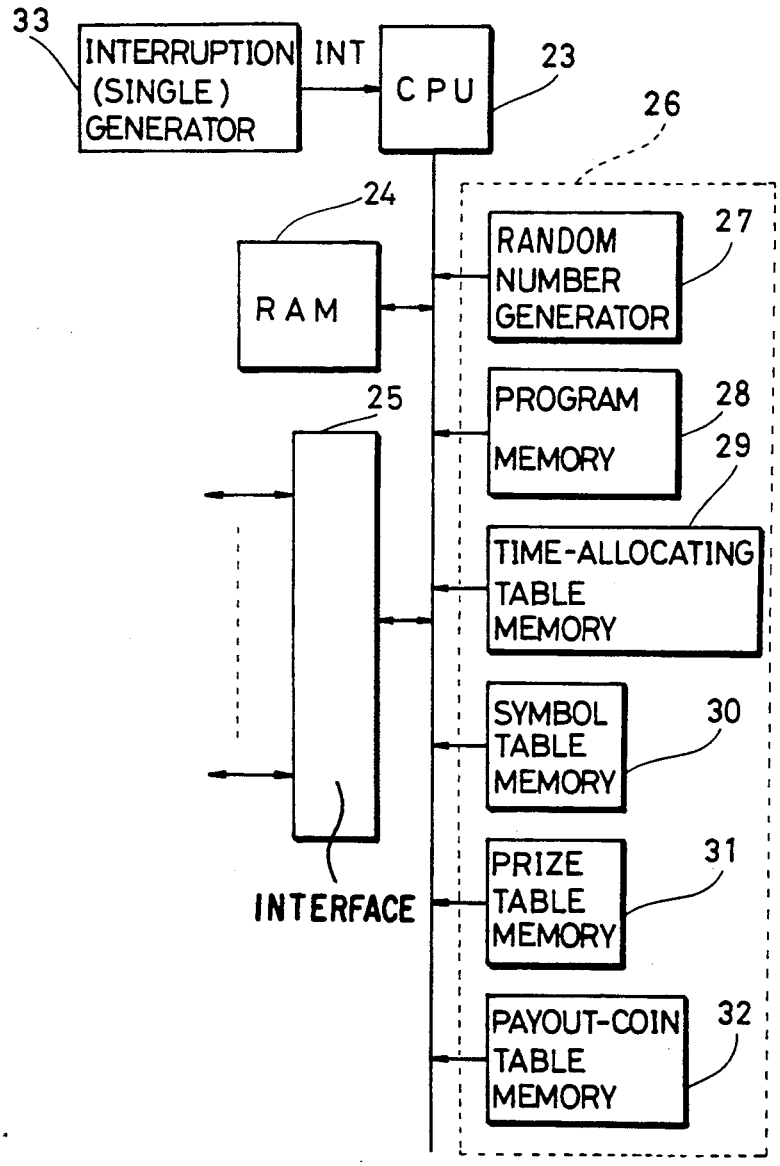
FIG. 3 is a block diagram showing a combination of a microcomputer.

FIG. 3 shows a schematic configuration of a microcomputer 17, which contains a CPU 23, RAM 24, ROM 26 and an interface 25. The above-mentioned CPU 23 is a main unit for control and operation, and is designed to read and execute the program which is stored in a program memory 28. While reading and writing data for RAM 24, it executes various controls related to the proceedings of the game and payment of coins. The CPU 23 and the input-output devices are connected through interface 25.

The above-mentioned ROM 26 contains random number generator 27, program memory 28, time-allocating table memory 29, symbol table memory 30, prize table memory 31 and payout coin amount table memory 32. The above-mentioned random number generator 27 generates random number data for regulating the time length of rotation of each reel 4*a*, 4*b* and 4*c*. In the case of a slot machine shown, after the start of rotation of each reel 4*a*, 4*b* and 4*c*, it first generates the random number data for the first reel 4*a*, and after the stop of the first reel 4*a*, generates the random number data for the second reel 4*b*, and after the stop of the second reel 4*b*, generates the random number data for the third reel 4*c*.

The above-mentioned time-allocating table memory 29 is for storing the time-allocating table TB for allocating time data to each symbol on each reels 4*a*, 4*b* and 4*c*, of which a concrete example of time-allocating table TB is shown in FIG. 5.

According to FIG. 5, with regard to the first reel 4*a*, a time data "1" is allotted to the first symbol "M7", and "2" which is longer than "M7" is allocated to the third symbol "1B" as the time data.

By the way, numerals 1–22 represent the order in the symbol alignment of each symbol, which correspond to the appointed value by the pointers SP1, SP2 and SP3 which are described later.

The above-mentioned symbol table memory 30 is for storing such table which makes the appointed value by each pointer SP1, SP2 and SP3 correspond with the data of positions of corresponding symbols to stop on the stop line 6. The CPU 23 stops driving of each reel's stepping motor when the counted value of the driving pulses given to the stepping motor of each reel's drive unit 18*a*–18*c* coincides with the position data obtained by reference to symbol table memory 30.

The above-mentioned prize table memory 31 stores the table indicating all combinations of symbols relative to winning games and the above-mentioned payout-coin amount memory 32 is for storing the table which sets up the amount of coins to be paid out on all modes of combinations of symbols relative to winning games. When all reels 4*a*, 4*b* and 4*c* come to a stop, CPU 23 determines the combination of symbols aligned on the stop line 6, if the game is won or not, and, if won, decides the amount of coins to be paid out with reference made to the payout coin amount table memory 32, thereby operating the coin-payout unit 19.

Figure 7:
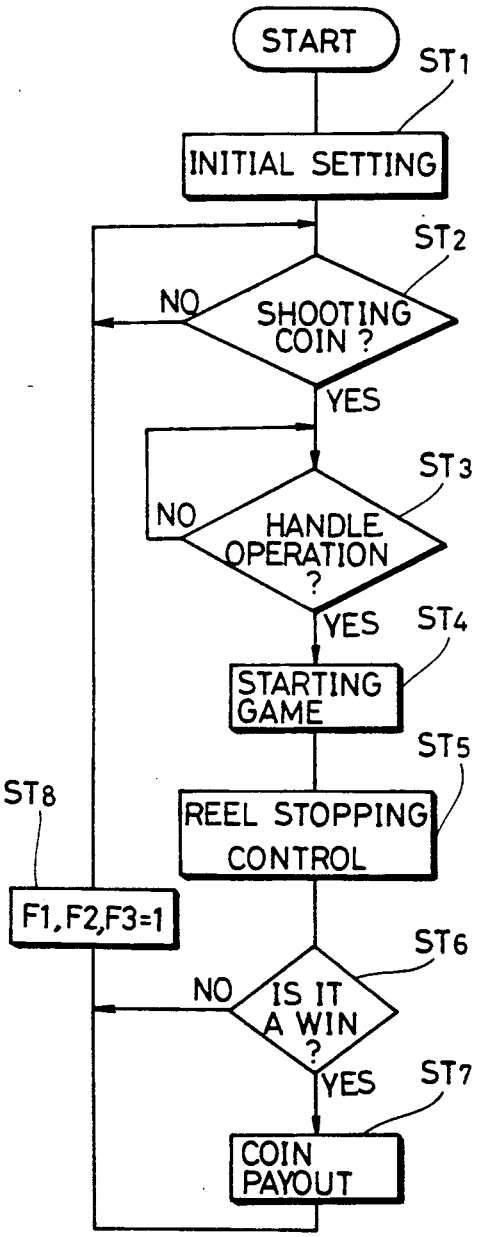
FIG. 7 is a flow chart showing the control procedures of the CPU.
Figure 8:
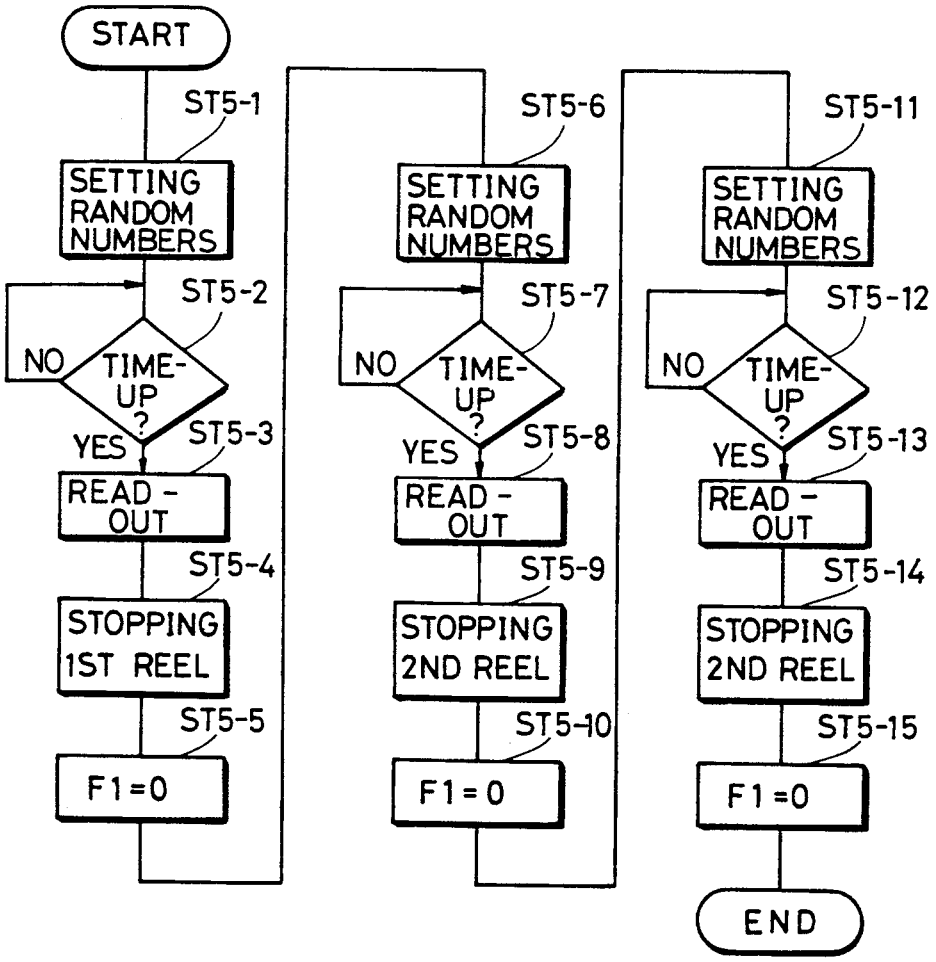
FIG. 8 is a flow chart showing the procedures in detail of Step 5 in FIG. 7.
Figure 9:
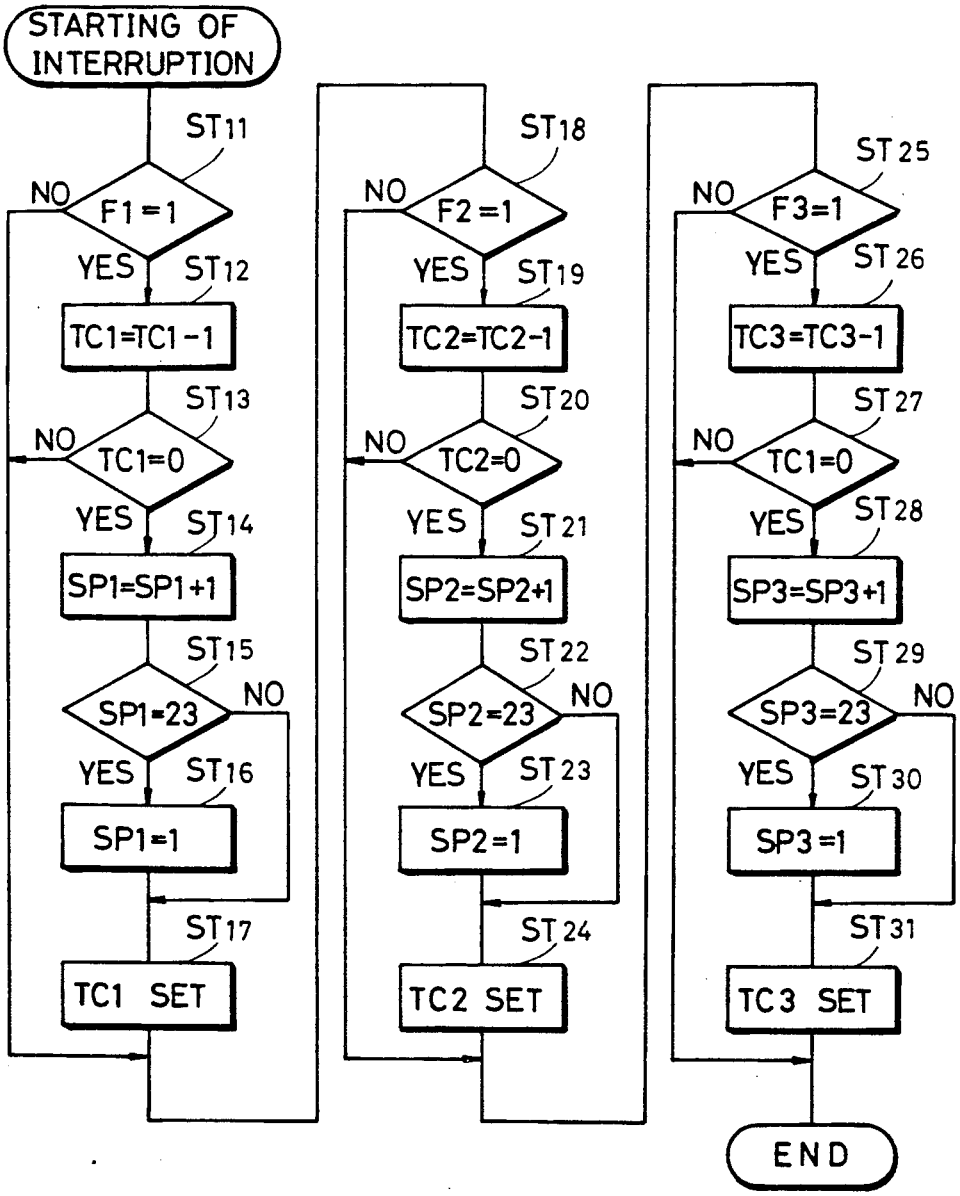
FIG. 9 is a flow chart showing the control procedures by the CPU at the time when an interruption has taken place.

An interruption generator 33 is connected to the above-mentioned CPU 23, which goes into the routine as shown in FIG. 9, when the interruption generator 33 generates interruption signal INT at a certain time interval, interrupting such routines as shown in FIGS. 7 and 8, which will be described later.

FIG. 6 shows the work area WE in the above-mentioned RAM 24, and provides pointers SP1, SP2 and SP3 for appointing symbols one by one on each reel on the above-mentioned time allocating table TB with regard to each reel 4*a*, 4*b* and 4*c*, and the time counters TC1, TC2 and TC3 for counting the time length for appointing each symbol by pointers SP1, SP2 and SP3.

FIG. 7 shows the control procedures of CPU 23 for the slot machine of the above-mentioned configuration.

In Step 1 of said figure (indicated as "ST1"), after setting up the initial data in the work area WE of RAM 24, for instance, SP1=SP2=SP3=1, TC1=TC2=1, TC3 =2 (refer to FIG. 5), CPU 23 performs a determination in the following Step 2 whether coins have been shot or inserted into the machine or not and whether the game-start handle or game-start button switch has been activated in Step 3.

When the determination in Step 2 and 3 is "YES", after starting the game by putting all reels 4*a*, 4*b* and 4*c* together into rotation in Step 4, CPU 23 executes a control signal to stop reels in Step 5.

FIG. 8 shows the detailed processes of Step 5; first, after generating data of random numbers by random number generator 27 with regard to the first reel 4*a*, in Step 5-1, CPU 23 counts the time corresponding to said random number data to determine if the time has elapsed in Step 5-2. This time counting is done by the timer contained in CPU 23. With the time up, turning Step 5-2 to YES, the procedure proceeds to Step 5-3 to read out the appointed value of pointer SP1.

In the next Step 5-4, after converting the above-mentioned appointed value to the corresponding position data with reference made to symbol table memory 30, CPU 23 brings the stepping motor of the drive unit 18*a* of the first reel 4*a* to a stop.

Next, in Step 5-5, CPU 23 resets F1 for executing the procedure in FIG. 9 (Steps 12–17) as to the first reel 4*a*, which is described later, to the flag area held by CPU 23.

When the stop control procedure is finished with regard to this first reel 4*a*, and after the random number data as to the second reel 4*b* is generated by the random number generator 27 in the next Step 5 - 6, the same procedure as above is executed as to the second reel 4*b* in the following Steps 5-7 through 5-10. Furthermore, when the stop control process is finished regarding the second reel 4*b*, and after the random number data is generated by the random number generator 27 with regard to the third reel 4*c* in Step 5-11, the same process is executed as to the third reel 4*c* in the following Steps 5-12 through 5-15.

When three reels 4*a*, 4*b* and 4*c* come to stop, by executing the above-mentioned procedure, the determination is made by CPU 23 whether the symbols of the reels stopped on the stop line 6 coincide with the mode of combination relative to a winning game in Step 6 of FIG. 7.

In case the determination in Step 6 turns out to be "NO", the procedure proceeds to Step 8, leaving the state intact, but if it is "YES", said procedure is advanced to Step 8 after paying out the defined amount of coins.

In this Step 8, CPU 23 sets the flags F1, F2 and F3 regarding each reel 4*a*, 4*b* and 4*c*, and after execution the interruption procedure of FIG. 9, returns to Step 1, standing by for the start of a new game.

FIG. 9 shows the control procedure as Steps 11 through 31 by CPU 23, when the interruption generator 33 generates the interruption signal INT.

In Step 11 of said figure, CPU 23 determines if the flag F1 is set or not; when the determination "YES", CPU 23 reduces the content of the counter TC in Step 12 by 1 regarding the first reel 4*a*. If the determination of Step 11 is NO, that is, if it is after the first reel 4*a* stops and is at a stage when the determination of game result is still to be made, the following steps Steps 12 through 17 are skipped.

In the next Step 13, a determination is made by CPU 23 whether if the content of the counter TC1 has become zero; if the determination in Step 13 "NO", the following Steps 14 through 17 are skipped, but if it is "YES", the procedure continues to Step 14, and CPU 23 adds 1 to the content of pointer SP1 to appoint the next symbol.

In the following Step 15, a determination is made whether the content of pointer SP1 has reached CPU 23, that is, whether all symbols on the first reel 4*a* have been appointed. If the determination is "NO", the procedure advances to Step 17, skipping Step 16, and if it is "YES", CPU 23 proceeds to Step 17 after reverting the content of pointer SP1 to the initial value and sets the time data allocated to the next symbol on the counter TC1.

As the procedure of the first reel 4*a* is finished, CPU 23 shifts to the procedure regarding reel 4*b*, it makes determination if the flag F2 is set; if the determination result is "NO", Steps 19 through 24 are skipped, and if "YES", the same procedures as the above-mentioned Steps are executed in Steps 19 through 24.

As the procedures of the second reel 4*b* are finished, CPU 23 proceeds to the procedure regarding the third reel 4*c*, to make determination if the flag F3 is set or not. If the determination is "NO", Steps 26 through 31 are skipped; and if "YES", the above-mentioned procedures are executed in Steps 26 through 31.

In the present invention, therefore, the time allocating table TB for allocating a voluntary time data is stored in the memory medium and the appointment of symbols on each reel 4*a*–4*c* is made one by one in the above-mentioned time allocation table TB by the above-mentioned symbol appointing medium, and the time length to appoint each symbol is counted by the time counting medium. At each time when the counting value counted coincides with the time length value in the above-mentioned time length allocating table TB, it renews the symbol appointed by operating the above-mentioned symbol appointing medium. Thus control of the stop action of each reel 4*a*–4*c* is performed so that the appointed symbols stop on the defined stop line by the above-mentioned appointing medium.

In this way, in order to change the probability of appearance of the combination mode of each symbol, it is sufficient to change the content of the time allocating table stored in the memory medium, and the number of symbols is irrelevant, making it possible to voluntarily change the probability of appearance with an extremely simple work.

Thus, the preferred embodiment of the present invention has been described in the above. It is possible for those in the trade to amend or modify it in accordance with the scope of the invention without deviating from the spirit of this invention.

It is therefore appreciated that the scope of the present invention can only be specified by the appending claims.

What is claimed is:

1. A stop-control device of a rotary gaming machine of the type including a plurality of rotary units, each provided with a plurality of symbols, with one of said symbols on each rotary unit to be stopped at a defined position, and drive means for rotatably driving said rotary units, said stop-control device comprising:

memory means for storing a time allocating table having time data for allocating respective time lengths to each symbol on each said rotary unit;

symbol appointing means for appointing one said symbol on each said rotary unit in accordance with said time data in said time allocating table;

counting means for counting the total time length of all said symbols appointed by said symbol appointing means in accordance with the time data in said time allocating table during rotation of each said rotary unit;

renewing means for renewing the appointed symbols by operating said symbol appointing means each time when the time length counted by said counting means coincides with the time length in said time allocating table; and stop-control means for controlling said drive means of each said rotary unit to stop the symbols appointed by the symbol appointing means on a defined stop line in response to the total time length counted by said counting means.

2. A stop-control device according to claim 1, wherein said rotary units are reels in said rotary machine, three such reels being disposed in a machine body at a position of a display window.

3. A stop-control device according to claim 1, wherein said symbol appointing means includes random number generating means for generating random number data to regulate the length of time of rotation of each said rotary unit.

4. A stop-control device according to claim 3, wherein said count means includes central processing means for counting the time length of each said symbol appointed by said symbol appointing means during rotation of each said rotary unit to determine if the counted time equals the length of time generated by said random number generating means.

5. A stop-control device according to claim 1, wherein said stop-control means includes central processing means for controlling said drive means of each said rotary unit to stop the symbols appointed by the symbol appointing means on a defined stop line.

6. A stop-control device according to claim 5, wherein said drive means includes stepping motor means for rotating each said rotary unit, and said central processing means controls drive pulses supplied to said stepping motor means.

7. A stop-control device according to claim 5, further including program memory means for storing a program used by said central processing means.

8. A stop-control device according to claim 1, further including prize table memory means for storing a table indicating all combinations of said symbols of said rotary units relative to winning games.

9. A stop-control device according to claim 8, further including payout coin table memory means for storing a table which sets up a monetary amount to be paid out for each combination stored in the table of said prize table memory means.

* * * * *